US008538291B2

(12) United States Patent
Mori

(10) Patent No.: US 8,538,291 B2
(45) Date of Patent: Sep. 17, 2013

(54) DEVELOPING CARTRIDGE

(75) Inventor: Hiroki Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 240 days.

(21) Appl. No.: 12/976,913

(22) Filed: Dec. 22, 2010

(65) Prior Publication Data

US 2011/0158686 A1 Jun. 30, 2011

(30) Foreign Application Priority Data

Dec. 25, 2009 (JP) ..... 2009-294592

(51) Int. Cl.
*G03G 15/04* (2006.01)

(52) U.S. Cl.
USPC ..... 399/119; 399/90

(58) Field of Classification Search
USPC ..... 399/119, 90
See application file for complete search history.

(56) References Cited

U.S. PATENT DOCUMENTS

| | | | |
|---|---|---|---|
| 7,945,184 | B2 | 5/2011 | Takagi |
| 2001/0026707 | A1 | 10/2001 | Miyabe et al. |
| 2006/0029418 | A1 | 2/2006 | Ishii et al. |
| 2006/0029419 | A1 | 2/2006 | Shiraki |
| 2006/0029420 | A1 | 2/2006 | Ishii et al. |
| 2006/0029421 | A1 | 2/2006 | Ishii et al. |
| 2006/0029422 | A1 | 2/2006 | Shiraki |
| 2006/0029423 | A1 | 2/2006 | Shiraki |
| 2008/0279583 | A1* | 11/2008 | Ishii et al. ..... 399/116 |

FOREIGN PATENT DOCUMENTS

| | | | |
|---|---|---|---|
| JP | H06-242669 | A | 9/1994 |
| JP | H08-220873 | A | 8/1996 |
| JP | 2001-201999 | A | 7/2001 |
| JP | 2006-072284 | A | 3/2006 |
| JP | 2006-330620 | A | 12/2006 |

OTHER PUBLICATIONS

Japan Patent Office, Notification of Reasons for Refusal for Japanese Patent Application No. 2009-294592 (counterpart to above-captioned patent application), mailed May 28, 2013.

* cited by examiner

*Primary Examiner* — Ryan Walsh
(74) *Attorney, Agent, or Firm* — Baker Botts L.L.P.

(57) ABSTRACT

A developing cartridge includes: a housing; a developing roller; a supply roller including a supply roller shaft; a bearing member, which rotatably holds the supply roller shaft, and which allows the supply roller shaft to move in an axial direction thereof; a supply electrode, which is disposed opposite to an end face of the supply roller shaft at a first end side of the supply roller shaft, and which is electrically connected to the supply roller shaft; a supply gear, which is attached to the supply roller shaft so as to not be rotatable relative to the supply roller shaft, and which is arranged at an outer side of the sidewall of the housing at a second end side of the supply roller shaft; and a gear cover which covers the supply gear. The supply roller shaft is axially restrained by the supply electrode and the gear cover.

4 Claims, 4 Drawing Sheets

DEVELOPING CARTRIDGE

CROSS-REFERENCE TO RELATED APPLICATIONS

This application claims priority from Japanese Patent Application No. 2009-294592 filed on Dec. 25, 2009, the entire subject matter of which is incorporated herein by reference.

TECHNICAL FIELD

Apparatuses and devices consistent with the invention relate to a developing cartridge that is detachably mounted to a main body of an image forming apparatus.

BACKGROUND

There is known an image forming apparatus such as laser printers, in which a developing cartridge is detachably mounted to a main body of the apparatus.

The developing cartridge includes a developing roller and a supply roller for supplying toner to the developing roller. A shaft of the developing roller is rotatably supported by a developing frame that configures a housing of the developing cartridge. In addition, a shaft of the supply roller is rotatably supported by the developing frame, and a circumferential surface of the supply roller contacts a circumferential surface of the developing roller.

As long as the supply roller contacts the circumferential surface of the developing roller, it is not necessary to position the supply roller in an axial direction with high precision. However, when the supply roller is highly moved in the axial direction, the supply roller may contact another member in the developing cartridge or toner may not be supplied to a part within a range corresponding to a printing area of the developing roller, so that an inferior developing may occur.

SUMMARY

In order to prevent the above problem, a restraint member may be provided to restrain the supply roller from moving in the axial direction. However, when the restraint member is provided, the number of parts is increased, so that the costs of the developing cartridge are increased.

Therefore, illustrative aspects of the invention provide a developing cartridge capable of restraining a supply roller from moving in an axial direction without increasing the costs.

According to one illustrative aspect of the present invention, there is provided a developing cartridge comprising: a housing; a developing roller that is rotatable about a developing roller axis line, which extends in a direction between a pair of opposite sidewalls of the housing; a supply roller, which is arranged between the pair of opposite sidewalls, which comprises a supply roller shaft extending in the direction between the opposite side walls, and which supplies developer to the developing roller; a bearing member, which rotatably holds the supply roller shaft, and which secures the supply roller shaft in a radial direction thereof and which allows the supply roller shaft to move in an axial direction thereof; a supply electrode, which is disposed opposite to an end face of the supply roller shaft at a first end side of the supply roller shaft, and which is electrically connected to the supply roller shaft; a supply gear, which is attached to the supply roller shaft so as to not be rotatable relative to the supply roller shaft, and which is arranged at an outer side of the sidewall of the housing at a second end side of the supply roller shaft that is opposite to the first side; and a gear cover, which is attached to the housing, and which covers the supply gear, wherein the supply roller shaft is axially restrained by the supply electrode and the gear cover.

According thereto, the developing cartridge includes the developing roller and the supply roller. The developing roller is rotatable about the developing roller axis line extending in an opposite direction of both sidewalls of the housing. The supply roller includes the supply roller shaft. The supply roller shaft extends in the opposite direction of both sidewalls and is rotatably held by the bearing member. In addition, the supply roller shaft is allowed to move in the axial direction and is secured in the radial direction by the bearing member. The supply electrode is opposed to an end face of one end side of the supply roller shaft. The supply electrode is electrically connected to the supply roller shaft. In addition, the supply gear is arranged at an outer side of the sidewall of the other end side of the housing. The supply gear is attached to the supply roller shaft so that the supply gear cannot be relatively rotated. The supply gear is covered by the gear cover that is attached to the housing.

The supply roller shaft is positioned in the axial direction by the supply electrode and the gear cover, so that the supply roller shaft is restrained from moving in the axial direction thereof. Accordingly, it is not necessary to separately provide a member for restraining the axial movement of the supply roller shaft. As a result, it is possible to restrain the axial movement of the supply roller without increasing the costs.

DETAILED DESCRIPTION

Hereinafter, an exemplary embodiment of the invention will be described in detail with reference to the drawings.

(1) Printer

Figure 1:
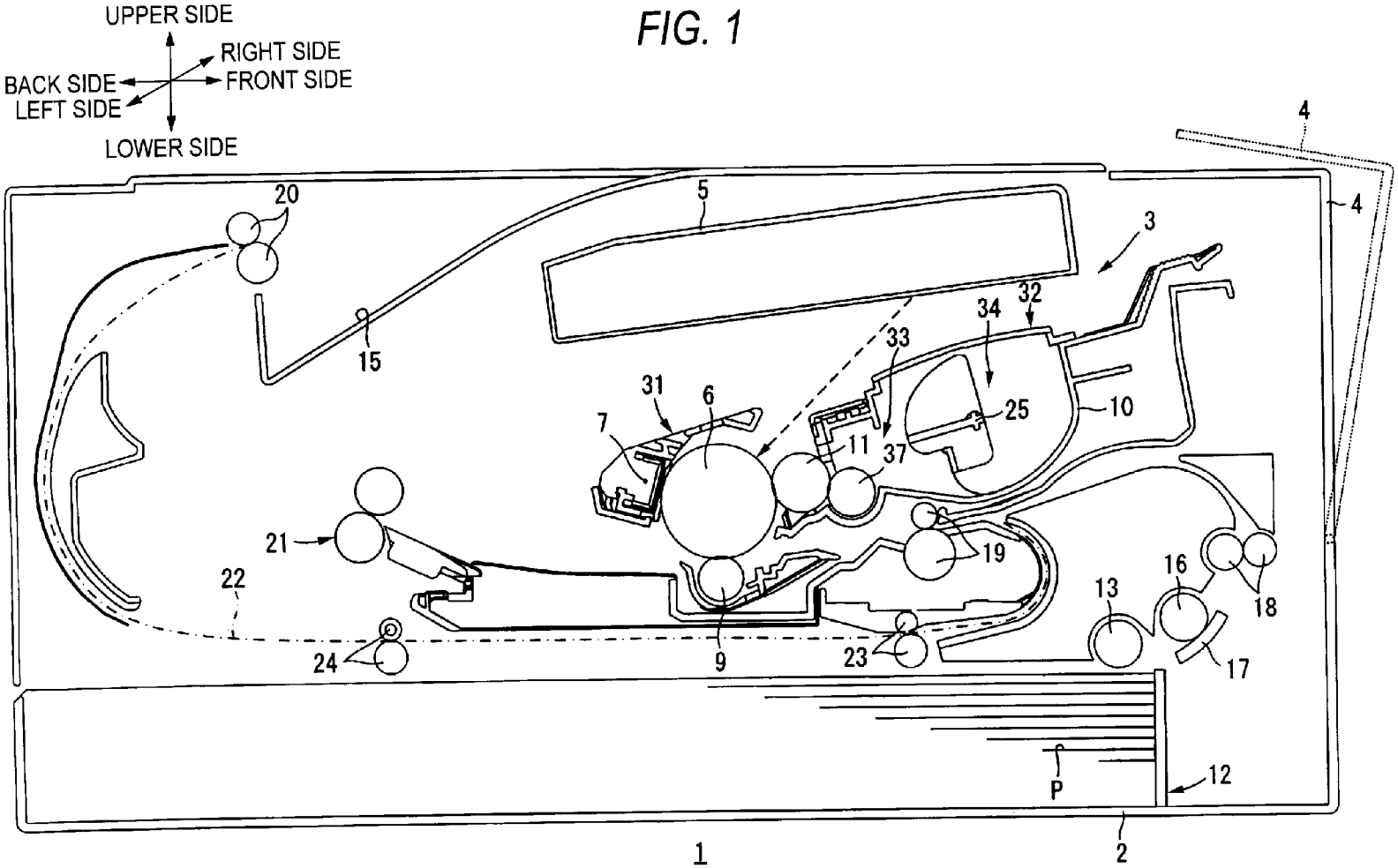
FIG. 1 is a side sectional view of a printer having a developing cartridge according to an exemplary embodiment of the invention.

As shown in FIG. 1, a printer 1 (one example of an image forming apparatus) includes a body casing 2 (one example of a main body).

A process cartridge 3 is provided at a center portion in the body casing 2. The process cartridge 3 is detachably mounted to the body casing 2 via a front cover 4 that is provided at one sidewall of the body casing 2.

In the following descriptions, a side at which the front cover 4 is provided to the body casing 2 is referred to as the front side and a side opposite to the front side is referred to as the back side. In addition, the left and the right are assigned based on viewing the printer from the front side of the printer 1. Additionally, regarding a developing cartridge 32, which will be described later, the front, back, left and right are set based on the state in which the developing cartridge is mounted to the body casing 2.

The process cartridge 3 includes a drum cartridge 31 and a developing cartridge 32. The developing cartridge 32 is detachably mounted to the drum cartridge 31.

The drum cartridge is provided with a rotatable photosensitive drum 6. The drum cartridge 31 includes a charger 7 and a transfer roller 9.

The photosensitive drum 6 is rotatable about an axis line extending in a direction perpendicular to a sheet face of FIG. 1.

The charger 7 is a scorotron-type charger and is arranged to be opposite to a circumferential surface of the photosensitive drum 6 with a predetermined interval provided between the charger 7 and the photosensitive drum.

The developing cartridge 32 includes a developing housing 10 (one example of the housing) that accommodates toner. In the developing housing 10, a developing chamber 33 and a toner accommodating chamber 34 (one example of a developer accommodating chamber), which accommodates toner supplied to the developing chamber 33, are provided adjacent to each other.

A developing roller 11 and a supply roller 37 are held in the developing chamber 33 such that the developing roller 11 and the supply roller 37 are rotatable with respect to the developing chamber 33.

The developing roller 11 has a circumferential surface, a part of which is exposed from a back end portion of the developing housing 10. In addition, the supply roller 37 has a circumferential surface that contacts a front side of the developing roller 11. The developing cartridge 32 is mounted to the drum cartridge 31 so that the part of the developing roller 11 exposed from the developing housing 10 contacts a circumferential surface of the photosensitive drum 6.

An agitator 25 is kept in the toner accommodating chamber 34 such that the agitator 25 is rotatable with respect to the toner accommodating chamber 34. Toner in the toner accommodating chamber 34 is supplied into the developing chamber 33 while being agitated by rotation of the agitator 25.

The transfer roller 9 is provided at a lower side of the photosensitive drum 6. The transfer roller 9 is rotatable about an axis line parallel to a rotation axis line of the photosensitive drum 6 and is arranged so that a circumferential surface of the transfer roller 9 contacts the circumferential surface of the photosensitive drum 6.

In the body casing 2, an exposure unit 5 that can emit laser and the like is arranged above the process cartridge 3.

When forming an image, the photosensitive drum 6 rotates at a constant speed in a clockwise direction in FIG. 1. In accordance with rotation of the photosensitive drum 6, the circumferential surface of the photosensitive drum 6 is uniformly charged by electric discharge from the charger 7. In the meantime, based on image data received from a personal computer (not shown) connected to the printer 1, a laser beam is emitted from the exposure unit 5. The laser beam passes between the charger 7 and the developing cartridge 32 and is irradiated on the circumferential surface of the photosensitive drum 6 that is positively charged to be uniform. Thereby, the circumferential surface of the photosensitive drum 6 is selectively exposed, and the electric charges are selectively removed from the exposed part, so that an electrostatic latent image is formed on the circumferential surface of the photosensitive drum 6.

When the electrostatic latent image is opposed to the developing roller 11 by rotation of the photosensitive drum 6, toner is supplied to the electrostatic latent image from the developing roller 11. Thereby, a toner image is formed on the circumferential surface of the photosensitive drum 6.

A sheet feeding cassette 12 that stores sheets P is arranged at a bottom part of the body casing 2. A pickup roller 13 for sending the sheet from the sheet feeding tray 12 is provided above the sheet feeding cassette 12.

A conveyance path 14, which has an S shape when seen from the side face, is formed in the body casing 2. The conveyance path 14 reaches a sheet discharge tray 15 formed at an upper surface of the body casing 2 via a portion between the photosensitive drum 6 and the transfer roller 9 from the sheet feeding cassette 12. A separation roller 16 and a separation pad 17, which are arranged to be opposite to each other, a pair of feeder rollers 18, a pair of register rollers 19 and a pair of sheet discharge rollers 20 are provided on the conveyance path 14.

The sheets P are fed from the sheet feeding cassette 12 one at a time while passing between the separation roller 16 and the separation pad 17. Then, the sheet P is fed toward the register rollers 19 by the feeder rollers 18. Then, the sheet P is registered by the register rollers 19 and is conveyed toward a portion between the photosensitive drum 6 and the transfer roller 9 by the register rollers 19.

The toner image formed on the circumferential surface of the photosensitive drum 6 is electrically attracted and transferred onto the sheet P by the transfer roller 9 when the toner image is opposed to the sheet P passing between the photosensitive drum 6 and the transfer roller 9 by the rotation of the photosensitive drum 6.

On the conveyance path 14, a fixing unit 21 is provided at a downstream side of a conveyance direction of the sheet P from the transfer roller 9. The sheet P, on which the toner image is transferred, is conveyed through the conveyance path 14 and passes through the fixing unit 21. The fixing unit 21 fixes the toner image on the sheet P by heating and pressing so as to form an image on the sheet P.

As operation modes, the printer 1 includes a one-sided mode for forming an image (toner image) on one side of the sheet P and a duplex mode for forming an image on one side of the sheet P and then forming an image on the other side of the sheet P.

In the one-sided mode, the sheet P having an image formed on one side thereof is discharged to the sheet discharge tray 15 by the sheet discharge rollers 20.

As a structure for realizing the duplex mode, the body casing 2 is formed therein with a reverse conveyance path 22. The reverse conveyance path 22 extends between the conveyance path 14 and the sheet feeding cassette 12 from the vicinity of the sheet discharge rollers 20 and is connected to a part between the feeder rollers 18 and the register rollers 19 on the conveyance path 14. On the reverse conveyance path 22, a pair of first reverse conveying rollers 23 and a pair of second reverse conveying rollers 24 are provided.

In the duplex mode, the sheet P having an image formed on one side thereof is conveyed to the reverse conveyance path 22 rather than being discharged to the sheet discharge tray 15. Then, the sheet P is conveyed through the reverse conveyance path 22 by the first reverse conveying rollers 23 and the second reverse conveying rollers 24 and two sides thereof are reversed, so that the other side of the sheet P, on which no image is formed, is sent to the conveyance path 14 with being opposed to the circumferential surface of the photosensitive drum 6. Then, an image is formed on the other side of the sheet P, so that the images are formed on both sides of the sheet P.

(2) Developing Cartridge

The developing housing 10 of the developing cartridge 32 has a box shape having an opened back side.

Figure 2:
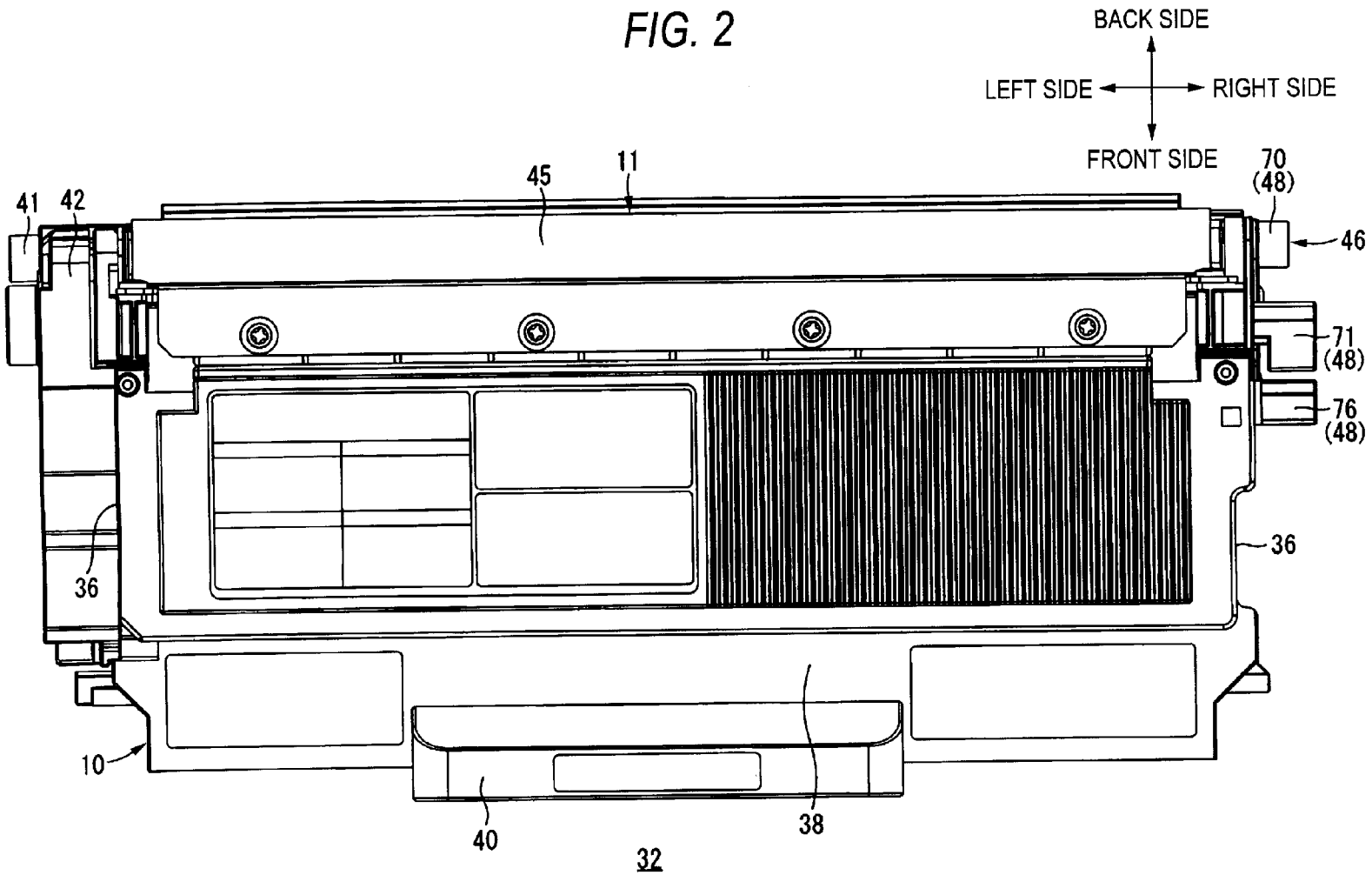
FIG. 2 is a plan view of the developing cartridge.
Figure 3:
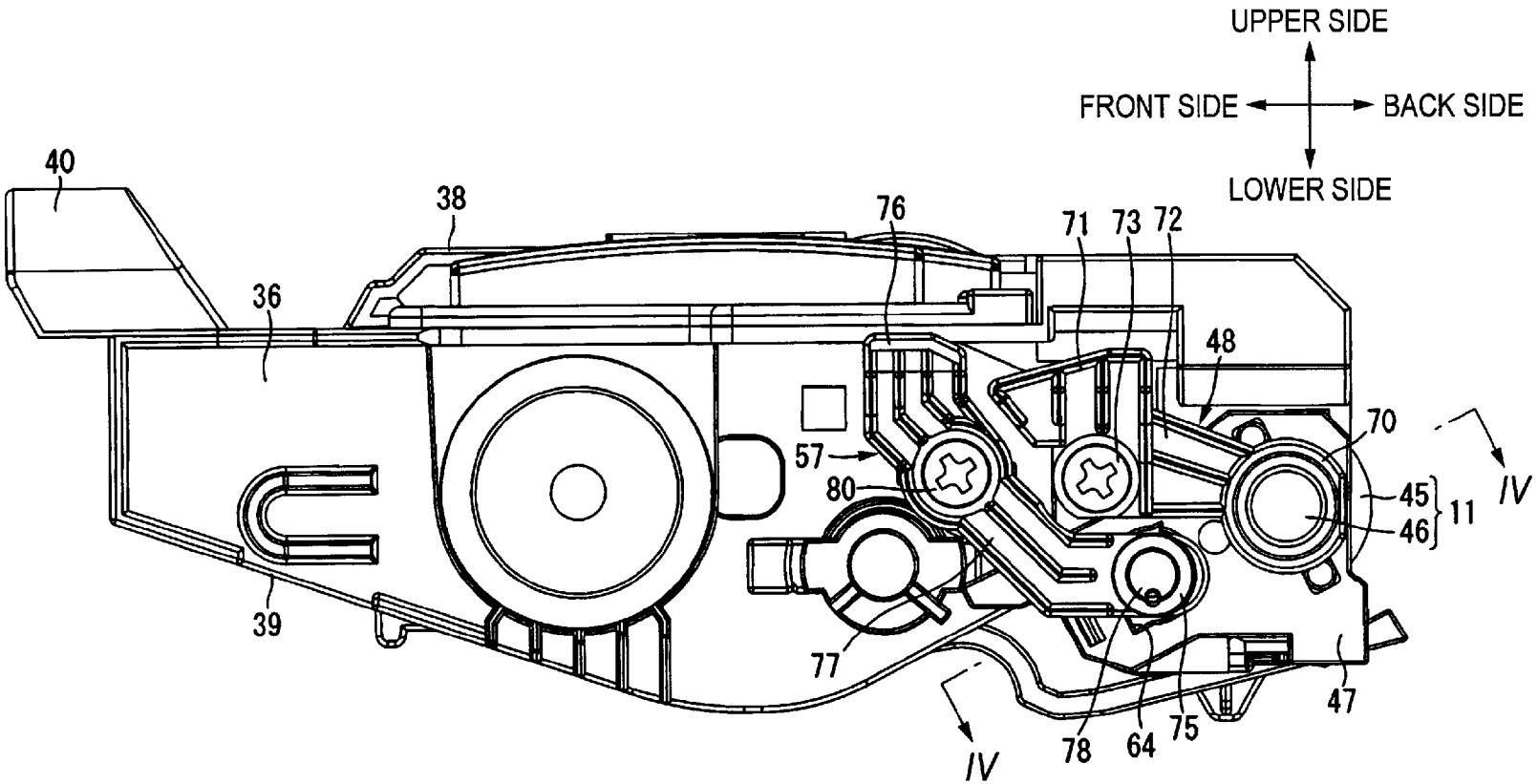
FIG. 3 is a right side sectional view of the developing cartridge.

As shown in FIG. 2, the developing housing 10 includes a pair of sidewalls 36, which are opposed to each other in the left-right direction. As shown in FIGS. 2 and 3, an upper wall 38 and a bottom wall 39 are bridged between the sidewalls 36. The upper wall 38 and the bottom wall 39 are connected at a front end portion of the developing housing 10. The connected part includes a holding part 40. The holding part 40 is extended toward the front-upper direction from the front end portion of the developing housing 10 and has a sectional U shape having an opened front side.

The developing roller 11 and the supply roller 37 (refer to FIG. 1) are rotatably held between the sidewalls 36.

(2-1) Developing Roller

As shown in FIGS. 2 and 3, the developing roller 11 is arranged between back end portions of the sidewalls 36. As shown in FIG. 5, the developing roller 11 includes a cylindrical developing roller main body 45 extending in the left-right direction and a developing roller shaft 46 extending along a central axis line of the developing roller main body 45.

Both end portions of the developing roller shaft 46 penetrate the sidewalls 36 of the housing 10.

(2-2) Supply Roller

As shown in FIG. 1, the supply roller 37 is arranged at a position of the front-lower direction of the developing roller 11. As shown in FIG. 5, the supply roller 37 includes a cylindrical supply roller main body 55 extending in the left-right direction and a supply roller shaft 56 extending along a central axis line of the supply roller main body 55.

A circumferential surface of the supply roller body 55 contacts a circumferential surface of the developing roller body 45 from a front-lower side.

Both end portions of the supply roller shaft 56 penetrate both sidewalls 36 of the developing housing 10.

(2-3) Bearing Member

As shown in FIGS. 3 and 4, a right bearing member 47, which is one example of a bearing member, is provided at an outer side of the right sidewall 36. The right end portions of the developing roller shaft 46 and the supply roller shaft 56 are supported by the right sidewall 36 via the right bearing member 47 so that they can be rotated relative to each other. In other words, the right bearing member 47 collectively holds the right end portion of the developing roller shaft 46 and the right end portion of the supply roller shaft 56, thereby securing the developing roller shaft 46 and the supply roller shaft 56 in their radial directions.

As shown in FIG. 3, the right bearing member 47 has a substantially triangle shape when seen from a side face.

Figures 4A, 4B:
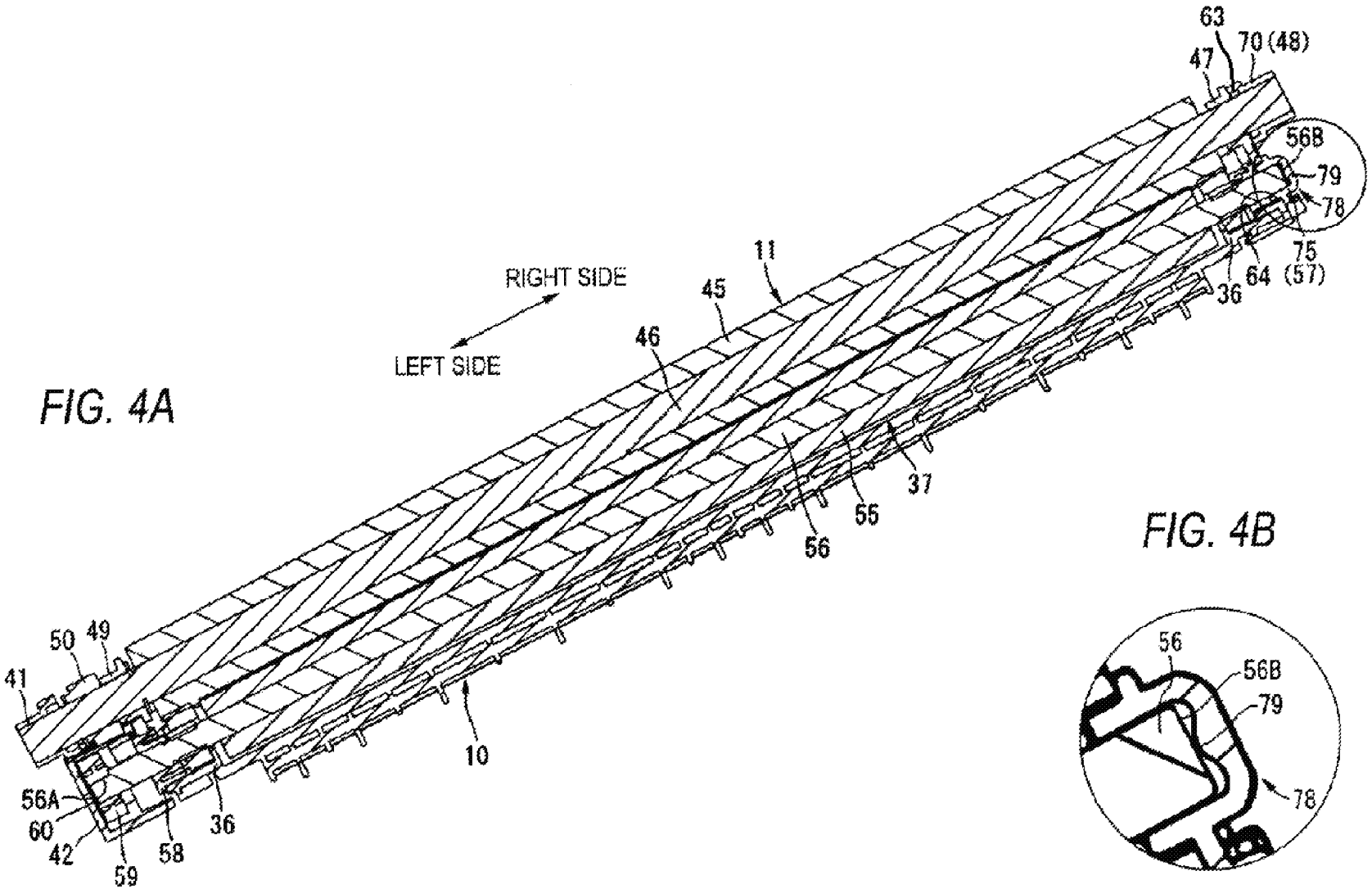
FIG. 4A is a sectional view of the developing cartridge taken along a line IV-IV of FIG. 3.
FIG. 4B is a partial enlarged view of FIG. 4A.

As shown in FIG. 4A, the right bearing member 47 is formed with a first shaft insertion penetration hole 63, into which the developing roller shaft 46 is inserted. The first shaft insertion penetration hole 63 has an inner diameter that is substantially the same as an outer diameter of the developing roller shaft 46. A leading end portion of the developing roller shaft 46 is further protruded in the outer side (right side) than the right bearing member 47.

Further, as shown in FIG. 4A, a second shaft insertion penetration hole 64 is formed in the right bearing member 47 at a position opposed to the supply roller shaft 56 in the left-right direction. The second shaft insertion penetration hole 64 includes a substantially angled hole having a size that is larger than an outer diameter of the supply roller shaft 56. A right end portion of the supply roller shaft 56 is inserted into the second shaft insertion penetration hole 64, and a leading end portion thereof is further protruded in the outer side (right side) than the right bearing member 47. In addition, a gap is formed between an inner surface of the second shaft insertion penetration hole 64 and the supply roller shaft 56.

Left bearing members 49, 58 are provided at an outer side of the left sidewall 36.

The left end portion of the developing roller shaft 46 is supported to the left sidewall 36 via the left bearing member 49 so that the left end portion of the developing roller shaft 46 can be relatively rotated.

In addition, the left end portion of the supply roller shaft 56 is supported by the left sidewall 36 via the left bearing member 56 so that the left end portion of the supply roller shaft 56 can be relatively rotated.

(2-4) Gear Device

As shown in FIGS. 2 and 4, a gear cover 42 is attached to the left end portion of the developing cartridge 32.

As shown in FIG. 4A, the left end portion of the developing roller shaft 46 is protruded from the gear cover 42 in the left direction, and the protruded portion is attached with a cylindrical collar member 41.

A developing gear 50 is attached to developing roller shaft 46 between the gear cover 42 and the left sidewall 36 so that the developing gear 50 cannot be relatively rotated. Driving force for driving the developing roller 11 is input to the developing gear 50 under a state in which the developing cartridge 32 (process cartridge 13) is mounted in the body casing 2.

The left end portion of the supply roller shaft 56 is arranged between the gear cover 42 and the left sidewall 36. In addition, a supply gear 59 is attached to the supply roller shaft 56 between the gear cover 42 and the left sidewall 36 so that the supply gear 59 cannot be relatively rotated. Specifically, an insertion hole 60 is formed in the supply gear 59. The left end portion of the supply roller shaft 56 is cut to have a D-shape section formed by partially cutting a part of the circumferential surface of the left end portion of the supply roller shaft 56. The D-shape part is inserted into the insertion hole 60 of the supply gear 59. According thereto, the supply gear 59 is attached to the supply roller shaft 56 so that the supply gear 59 cannot be relatively rotated.

A left end face 56A of the supply roller shaft 56 is not protruded from the supply gear 59 in the left direction, and a left end face of the supply gear 59 is contacted to an inner side face (right side face) of the gear cover 42. Thereby, the supply roller shaft 56 is restrained from moving in the left direction.

(3) Structure for Supplying Power to Developing Roller and Supply Roller

As shown in FIG. 3, a developing electrode 48 and a supply electrode 57 are provided at an outer side of the right sidewall 36.

(3-1) Developing Electrode

The developing electrode 48 is made of conductive resin. The developing electrode 48 integrally includes a developing connection part 70, a developing protrusion 71 and a developing coupling part 72.

The developing connection part 70 has a cylindrical shape. As shown in FIG. 4A, the protruded portion of the developing roller shaft 46, which protrudes rightward from the right bearing member 47, is inserted in the developing connection part 70. Thereby, the developing electrode 48 contacts the circumferential surface of the developing roller shaft 46, so that the developing electrode 48 and the developing roller shaft 46 are electrically connected.

As shown in FIG. 3, the developing protrusion 71 has a plate shape that is further protruded in the left direction than the developing connection part 70 at the rear-upper position of the developing connection part 70.

The developing coupling part 72 has a plate shape extending in the substantially front-rear direction. The developing coupling part 72 couples the developing connection part 70 and the developing protrusion 71. A screw hole (not shown) is formed in the developing coupling part 72. A screw 73 is engaged with the right sidewall 36 through the screw hole, so that the developing electrode 48 is fixed to the developing housing 10 of the developing cartridge 32.

When the process cartridge 3, in which the developing cartridge 32 is mounted to the drum cartridge 31, is mounted in the body casing 2, a main body-side developing electrode (not shown) provided in the body casing 2 is connected to the developing protrusion 71. When a developing bias is input to the developing protrusion 71 from the main body-side developing electrode, the developing bias is applied to the developing roller shaft 46 through the developing coupling part 72 and the developing connection part 70.

(3-2) Supply Electrode

The supply electrode 57 is made of conductive resin. The supply electrode 57 integrally includes a supply connection part 75, a supply protrusion 76 and a supply coupling part 77.

The supply connection part 75 has a cylindrical shape. A right end portion of the supply connection part 75 is sealed by a seal plate 78. As shown in FIGS. 4A and 4B, a protrusion 79, which protrudes toward the left direction, is formed at a central portion of a left side face of the seal plate 78.

The supply connection part 75 is fitted to a gap between the protruded part of the supply roller shaft 56, which is rightward protruded from the right bearing member 47, and the second shaft insertion penetration hole 64 formed at the right bearing member 47. Thereby, the right end portion of the supply roller shaft 56 is inserted into the cylindrical supply connection part 75, and the supply electrode 57 is fixed to the right bearing member 47. In addition, the protrusion 79 of the seal plate 78 is contacted to a right end face 56B of the supply roller shaft 56. Thereby, the supply roller shaft 56 is restrained from moving in the right direction.

In addition, since the protrusion 79 of the seal plate 78 contacts the supply roller shaft 56, the supply electrode 57 and the supply roller shaft 56 are electrically connected via the seal plate 78.

As shown in FIG. 3, the supply protrusion 76 has a plate shape that is further protruded in the left direction than the supply connection part 75 at the rear-upper position regarding the supply connection part 75. In addition, the supply protrusion 76 is arranged at the front of the developing protrusion 71 of the developing electrode 48. In other words, the developing protrusion 71 and the supply protrusion 76 are arranged side by side in the front-rear direction.

The supply coupling part 77 has a plate shape extending from the rear-lower side to the front-upper side and couples the supply connection part 75 and the supply protrusion 76. Further, a screw hole (not shown) is formed in the supply coupling part 77. A screw 80 is engaged with the right sidewall 36 through the screw hole, so that the supply electrode 57 is fixed to the developing housing 10 of the developing cartridge 32.

When the process cartridge 3 (refer to FIG. 1), in which the developing cartridge 32 is mounted to the drum cartridge 31, is mounted in the body casing 2, a main body-side supply electrode (not shown) provided in the body casing 2 is connected to the supply protrusion 76. When a supply bias is input to the supply protrusion 76 from the main body-side supply electrode, the supply bias is applied to the supply roller shaft 56 through the supply coupling part 77 and the protrusion 79 of the supply connection part 75.

As described above, the developing cartridge 32 includes the developing roller 11 and the supply roller 37. The developing roller 11 is rotatable about the developing roller shaft 46 extending in the left-right direction of the developing housing 10. The supply roller 37 includes the supply roller shaft 56. The supply roller shaft 56 extends in the left-right direction and is rotatably held to the right bearing member 47. In addition, the supply roller shaft 56 is allowed to move in the left-right direction and is secured in the radial direction by the right bearing member 47. The supply electrode 57 is provided which is opposed to the right end face 56B of the supply roller shaft 56. The supply electrode 57 is electrically connected to the supply roller shaft 56. In addition, the supply gear 59 is arranged at an outer side of the left sidewall 36 of the developing housing 10. The supply gear 59 is attached to the supply roller shaft 56 so that it cannot be relatively rotated. The supply gear 59 is covered by the gear cover 42 that is attached to the developing housing 10.

The supply roller shaft 56 is positioned in the left-right direction by the supply electrode 57 and the gear cover 42, so that the supply roller shaft 56 is restrained from moving in the left-right direction. Accordingly, it is not necessary to separately provide a member for restraining the axial (left-right) movement of the supply roller shaft 56. As a result, it is possible to restrain the axial movement of the supply roller 37 without increasing the costs.

The insertion hole 60, into which the supply roller shaft 56 is inserted, is formed in the supply gear 59. The supply roller shaft 56 is inserted into the insertion hole 60 so that it does not protrude from the supply gear 59 in the left direction. Thereby, the left end face (the end face of the part inserted into the supply gear 59) of the supply roller shaft 56 is not contacted to the gear cover 42. According thereto, it is possible to prevent the gear cover 42 from being worn due to the contact of the gear cover to the supply roller shaft 56 even when the end portion of the supply roller shaft 56 is D-cut.

Further, as the protrusion 79 formed at the supply electrode 57 contacts the right end face 56B of the supply roller shaft 56, the supply electrode 57 and the supply roller shaft 56 are electrically contacted. The protrusion 79 has a shape protruding toward the supply roller shaft 56. Accordingly, the protrusion 79 is point-contacted to the supply roller shaft 56. Therefore, it is possible to minimize the friction occurring between the supply roller shaft 56 and the supply electrode 57, and thus it is possible to reduce the resistance that is generated by the supply roller shaft 56 due to the friction.

(4) Modified Exemplary Embodiment

An exemplary embodiment of the invention has been described above. However, the invention can be implemented according to another exemplary embodiment.

For example, in the above exemplary embodiment, a white-black printer has been described as an example of the image forming apparatus. However, a color printer may be adopted as an example of the image forming apparatus. In this case, the invention can be applied to a developing cartridge that is detachably mounted to the color printer.

What is claimed is:

1. A developing cartridge comprising:

a housing;

a developing roller that is rotatable about a developing roller axis line, which extends in a direction between a pair of opposite sidewalls of the housing;

a supply roller, which is arranged between the pair of opposite sidewalls, which comprises a supply roller shaft extending in the direction between the opposite side walls, and which is configured to supply developer to the developing roller;

a bearing member configured to:

rotatably hold the supply roller shaft;

secure the supply roller shaft in a radial direction thereof; and allow the supply roller shaft to move in an axial direction thereof;

a supply electrode, which is disposed opposite to an end face of the supply roller shaft at a first end side of the supply roller shaft, and which is configured to be electrically connected to the supply roller shaft;

a supply gear, which is attached to the supply roller shaft so as to not be rotatable relative to the supply roller shaft, and which is arranged at an outer side of the sidewall of the housing at a second end side of the supply roller shaft that is opposite to the first end side; and a gear cover, which is attached to the housing, and which covers the supply gear from the second end side, wherein the supply electrode and the gear cover axially restrain the supply roller shaft to position the supply roller shaft in the axial direction in the housing.

2. The developing cartridge according to claim 1, wherein the supply gear comprises an insertion hole into which the supply roller shaft is inserted, and wherein the supply roller shaft is inserted into the insertion hole so as to not protrude from the supply gear toward the second end side.

3. The developing cartridge according to claim 1, wherein the supply electrode comprises a protrusion that protrudes toward the second side, and wherein the protrusion is configured to contact the end face of the supply roller shaft at the first end side.

4. A developing cartridge comprising:

a housing comprising:

an upper wall, a bottom wall, and a pair of opposing sidewalls comprising:

a first-side sidewall located at a first side of the housing; and a second-side sidewall located at a second side of the housing, wherein the second is opposite to the first side, and wherein the first-side sidewall and the second-side sidewall bridge the upper and bottom walls;

a developing roller disposed between the pair of opposing sidewalls of the housing, wherein the developing roller comprises a developing roller shaft rotatable about a developing roller axis line that extends between the pair of opposing sidewalls;

a supply roller, which is disposed between the pair of opposing sidewalls, and which is configured to supply developer to the developing roller, wherein the supply roller comprises:

a supply roller shaft extending between the pair of opposing sidewalls; and an end face located at an end of the supply roller shaft, wherein the end face faces toward the first-side of the housing;

a bearing member, which is configured to rotatably hold the supply roller shaft, and which is configured to allow the supply roller shaft to move in an axial direction, while securing the supply roller shaft in a radial direction, wherein the bearing member is located outside the first-side sidewall of the housing, wherein the bearing member comprises a shaft insertion penetration hole, and the supply roller shaft protrudes through the first-side sidewall and the shaft insertion penetration hole to extend further toward the first side of the housing than the bearing member;

a supply electrode, which is configured to be electrically connected to the supply roller shaft, and which is formed on an outside of the first-side sidewall of the housing, wherein the supply electrode comprises:

a supply connection portion fitted into a gap between a portion of the supply roller that protrudes beyond the bearing member and the shaft insertion penetration hole formed in the bearing member;

a seal plate, which is connected to the supply connection portion, and which covers the end face of the supply roller shaft to seal the portion of the supply roller shaft that protrudes beyond the bearing member; and a protrusion located on an inside surface of the seal plate and protruding in the second-side direction toward the end face of the supply roller shaft to contact the end face of supply roller shaft;

a gear cover disposed outside of the second-side sidewall of the housing, wherein the supply roller shaft extends beyond the second-side sidewall toward the gear cover; and a supply gear attached to the supply roller shaft between the second-side sidewall and the gear cover so that the supply gear cannot be rotated relative to the supply roller shaft, wherein the supply roller shaft is inserted into an insertion hole formed in the supply gear so as to not protrude toward the gear cover beyond the supply gear, and wherein axial movement of the supply roller is restrained by the gear cover and the protrusion formed on the inside surface of the seal plate.

* * * * *